US010030413B2

(12) United States Patent
Kamimura et al.

(10) Patent No.: US 10,030,413 B2
(45) Date of Patent: Jul. 24, 2018

(54) OUTER HANDLE DEVICE FOR VEHICLE DOOR

(71) Applicant: KABUSHIKI KAISHA HONDA LOCK, Miyazaki-shi, Miyazaki (JP)

(72) Inventors: Youichirou Kamimura, Miyazaki (JP); Isao Todaka, Miyazaki (JP); Tadashi Saitou, Miyazaki (JP)

(73) Assignee: KABUSHIKI KAISHA HONDA LOCK, Miyazaki (JP)

( * ) Notice: Subject to any disclaimer, the term of this patent is extended or adjusted under 35 U.S.C. 154(b) by 0 days.

(21) Appl. No.: 15/626,424

(22) Filed: Jun. 19, 2017

(65) Prior Publication Data

US 2017/0362855 A1 Dec. 21, 2017

(30) Foreign Application Priority Data

Jun. 21, 2016 (JP) ..... 2016-122396

(51) Int. Cl.
*E05B 17/18* (2006.01)
*E05B 77/34* (2014.01)
*E05B 85/16* (2014.01)

(52) U.S. Cl.
CPC ..... *E05B 17/186* (2013.01); *E05B 77/34* (2013.01); *E05B 85/16* (2013.01)

(58) Field of Classification Search
CPC ..... Y10T 70/7955; Y10T 70/8649; Y10T 70/5761; Y10T 70/5792; Y10T 70/5889;
(Continued)

(56) References Cited

U.S. PATENT DOCUMENTS 2,125,783 A * 8/1938 Heeman ..... E05B 1/0061 16/412
2,217,730 A * 10/1940 Cooley ..... E05B 77/34 428/31

(Continued)

FOREIGN PATENT DOCUMENTS

EP 2642049 A2 * 9/2013 ..... E05B 85/16
JP 62144365 9/1987

(Continued)

OTHER PUBLICATIONS

Kabushiki Kaisha Honda Lock, Excerpt of owner's manual and Sales release of Outer Handle Device for Vehicle Door, Jan. 9, 2016.; English translation included.

*Primary Examiner* — Suzanne L Barrett
(74) *Attorney, Agent, or Firm* — Rankin, Hill & Clark LLP

(57) ABSTRACT

Provided is an outer handle device for a vehicle door includes an outer handle and a cover. The outer handle includes a handle body that is disposed outside an outer panel of the vehicle door and extends in a front-rear direction of a vehicle. The cover is configured to cover, from an outside of the vehicle door, a cylinder lock located in a position adjacent to a first end of the handle body. The cover is configured to be attached to the outer panel and has an extension part, and the outer handle is turnable between a non-operation position and an operation position. While the outer handle is in the non-operation position, the extension part is engaged with a first end of the handle body and overlaps the first end of the handle body in a side view. While the outer handle is in the operation position, the engagement between the extension part and the first end of the handle body is released, and the cover is attachable to and detachable from the outer panel.

2 Claims, 13 Drawing Sheets

(58) Field of Classification Search
CPC ..... Y10T 70/7977; Y10T 16/44; E05B 85/16; E05B 79/04; Y10S 292/31; Y10S 292/54
USPC ..... 70/208, 210, 455, 423, 424, 427, 428
See application file for complete search history.

(56) References Cited

U.S. PATENT DOCUMENTS 6,240,755 B1 * 6/2001 Da Silva ..... E05B 17/186 292/336.3
7,526,936 B2 * 5/2009 Niskanen ..... E05B 17/185 70/423
8,359,712 B2 * 1/2013 Saitou ..... E05B 17/18 16/412
8,584,493 B2 * 11/2013 Gorontzi ..... E05B 1/0092 70/208
8,904,835 B2 * 12/2014 Bohm ..... E05B 85/107 292/336.3
9,593,514 B2 * 3/2017 Patel ..... E05B 83/36
2008/0190157 A1 * 8/2008 Mizuno ..... E05B 17/183 70/455
2010/0162777 A1 * 7/2010 Savant ..... E05B 17/186 70/101
2012/0154587 A1 * 6/2012 Hwang ..... B60R 1/00 348/148
2016/0145910 A1 * 5/2016 Beck ..... E05B 79/04 70/455
2016/0251878 A1 * 9/2016 Dikici ..... E05B 79/02
2016/0319573 A1 * 11/2016 Da Deppo ..... E05B 85/16
2017/0037655 A1 * 2/2017 Mathofer ..... E05B 17/183
2017/0058563 A1 * 3/2017 Ichikawa ..... E05B 77/34
2017/0159332 A1 * 6/2017 Beck ..... E05B 81/90

FOREIGN PATENT DOCUMENTS

JP 2002295063 A * 10/2002
JP 2010501746 1/2010
JP WO 2015137492 A1 * 9/2015 ..... E05B 85/06

* cited by examiner

OUTER HANDLE DEVICE FOR VEHICLE DOOR

CROSS-REFERENCE TO RELATED APPLICATION

This application claims priority from Japanese Patent Application No. 2016-122396 filed with the Japan Patent Office on Jun. 21, 2016, the entire content of which is hereby incorporated by reference.

BACKGROUND

1. Technical Field

The present disclosure relates to an outer handle device for a vehicle door.

2. Related Art

JP-UM-A-62-144365 discloses a door panel provided with a cylinder lock having an end covered with a magnetic rubber cover that is configured to be magnetically attracted to the door panel. JP-T-2010-501746 discloses an outer handle including a handle body, a cylinder lock having a cylinder housing, and a cover which is proximate to and face an end of the handle body and which is resiliently engaged with the cylinder housing.

SUMMARY

An outer handle device for a vehicle door according to an embodiment of the present disclosure includes: an outer handle (16, 56) provided to a vehicle door (DA, DB); and a cover (38, 70A, 70B). The outer handle (16, 56) includes a handle body (17, 57) that is disposed outside an outer panel (15, 55) of the vehicle door (DA, DB) and extends in a front-rear direction of a vehicle. The cover (38, 70A, 70B) is configured to cover, from an outside of the vehicle door (DA, DB), a cylinder lock (30, 64) located in a position adjacent to a first end (17*a*, 57*a*) of the handle body (17, 57). The cover (38, 70A, 70B) is configured to be attached to the outer panel (15, 55) or an attached member (19, 65A, 65B) that is to be attached to the outer panel (15, 55), the cover (38, 70A, 70B) has an extension part (39*a*, 70*f*), and the outer handle (16, 56) is turnable between a non-operation position and an operation position. While the outer handle (16, 56) is in the non-operation position, the first end (17*a*, 57*a*) of the handle body is proximate to the outer panel (15, 55), and the extension part (39*a*, 70*f*) is engaged with the first end (17*a*, 57*a*) of the handle body and overlaps the first end (17*a*, 57*a*) of the handle body in a side view. While the outer handle (16, 56) is in the operation position, the first end (17*a*, 57*a*) of the handle body is away from the outer panel (15, 55), the engagement between the extension part (39*a*, 70*f*) and the first end (17*a*, 57*a*) of the handle body is released, and the cover (38, 70A, 70B) is attachable to the attached member (19, 65A, 65B) or the outer panel (15, 55) and is detachable from the attached member (19, 65A, 65B) or the outer panel (15, 55).

DESCRIPTION OF THE EMBODIMENTS

Figure 1:
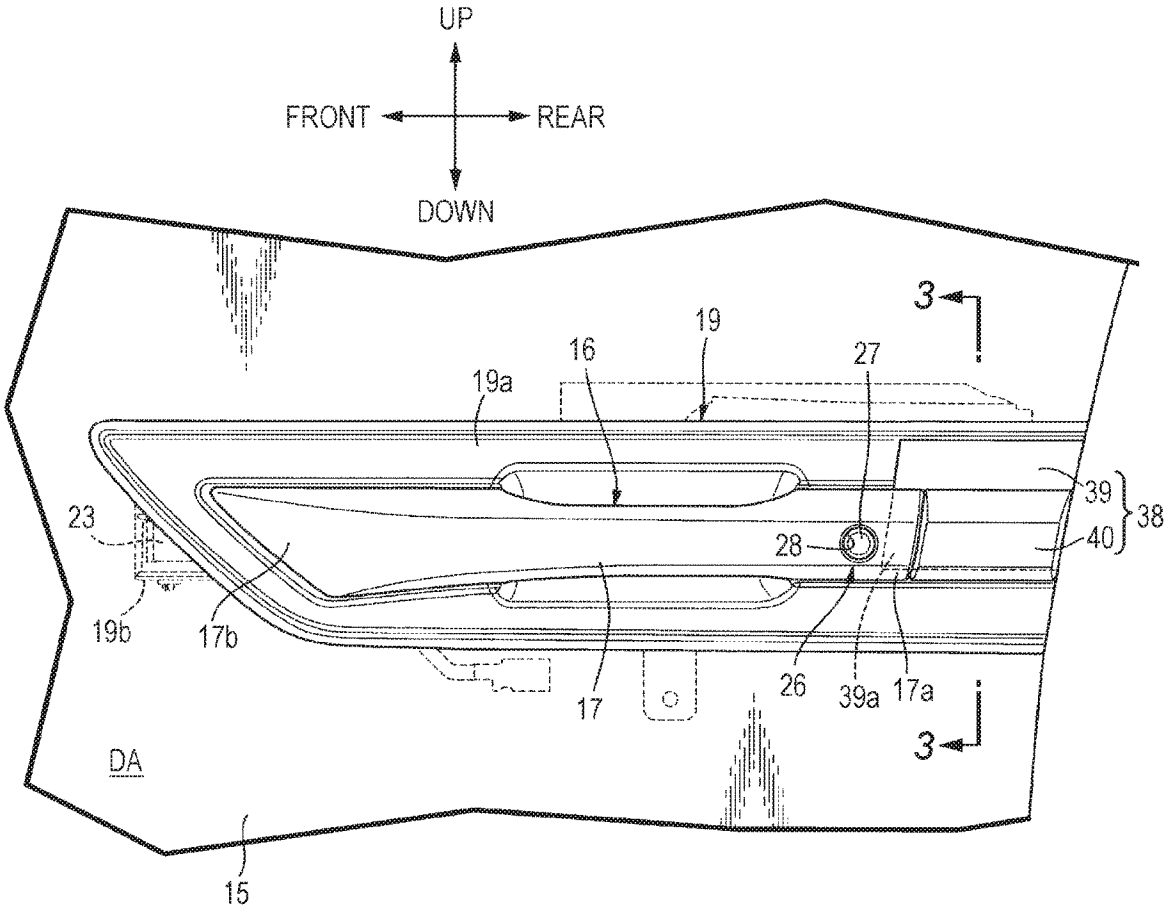
FIG. 1 is a side view of a part of a vehicle door according to a first embodiment.
Figure 2:
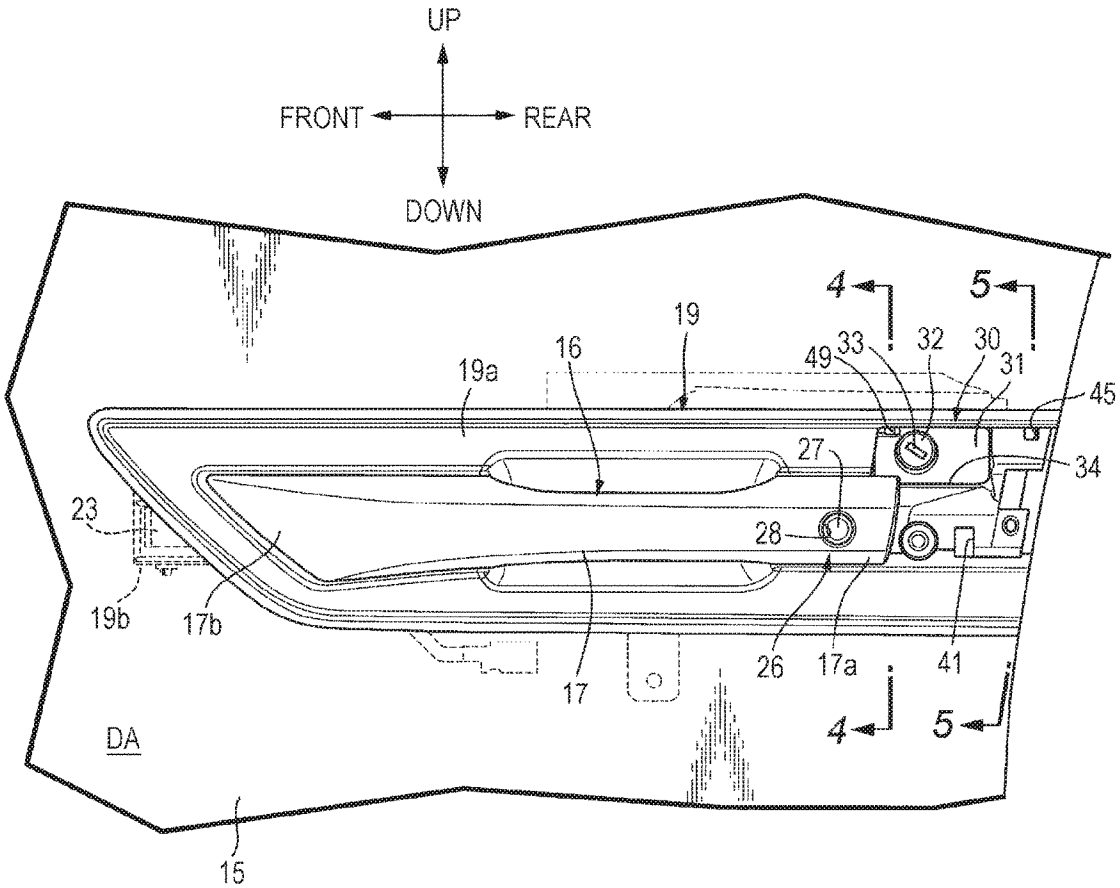
FIG. 2 is a side view of FIG. 1 from which a cover is detached.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In some cases, each of the cover for the outer handle device disclosed by JP-UM-A-62-144965 and the cover for the outer handle device disclosed by JP-T-2010-501746 might be detached undesirably due to an impact occurring when a vehicle user or the like comes in contact with the cover unintentionally.

An object of the present disclosure is to avoid the undesirable detachment of the cover for the outer handle device for the vehicle door even if the unintentional contact to the cover occurs.

The first aspect of an outer handle device for a vehicle door according to an embodiment of the present disclosure which achieves the object described above is as follows. The outer handle device includes: an outer handle provided to a vehicle door; and a cover. The outer handle includes a handle body that is disposed outside an outer panel of the vehicle door and extends in a front-rear direction of a vehicle. The cover is configured to cover, from an outside of the vehicle door, a cylinder lock located in a position adjacent to a first end of the handle body. The cover is configured to be attached to the outer panel or an attached member that is to be attached to the outer panel, the cover has an extension part, and the outer handle is turnable between a non-operation position and an operation position. While the outer handle is in the non-operation position, the first end of the handle body is proximate to the outer panel, and the extension part is engaged with the first end of the handle body and overlaps the first end of the handle body in a side view. While the outer handle is in the operation position, the first end of the handle body is away from the outer panel, the engagement between the extension part and the first end of the handle body is released, and the cover is attachable to the attached member or the outer panel and is detachable from the attached member or the outer panel.

The second aspect added to the configuration of the first aspect of the outer handle device for a vehicle according to an embodiment of the present disclosure is that: the cover includes an operation hole and an engagement part configured to be resiliently engaged with the attached member or the outer panel, and the elastic engagement between the engagement part and the attached member or the outer panel is releasable through the operation hole from an outside of the cover.

The third aspect added to the first or second aspect of the outer handle device for a vehicle according to an embodiment of the present disclosure is in that, while the outer handle is in the operation position, sliding the cover in the front-rear direction of the vehicle allows the cover to be detached from the attached member or the outer panel.

According to the above feature of the outer handle device of any of the embodiments, the cylinder lock is covered with the cover from the outside of the outer panel. Furthermore, the extension part of the cover is engaged with the first end of the handle body of the outer handle that is in the non-operation position. Thus, even if an impact occurred, e.g., when the vehicle user or the like comes in contact with the cover unintentionally is applied to the cover while the outer handle is in the non-operation position, the engagement between the first end of the handle body and the extension part is maintained, thereby avoiding undesirable detachment of the cover.

With reference to the drawings, the following describes embodiments of the present disclosure.

With reference to FIGS. 1 to 7, a first embodiment of the present disclosure will be described. As shown in FIGS. 1 to 5, for example, a vehicle door DA, which is a side door, includes an outer handle 16. The outer handle 16 includes a handle body 17, and the handle body 17 is disposed outside an outer panel 15 of the vehicle door DA and extends in a front-rear direction (i.e., a horizontal direction in FIGS. 1 and 2) of a vehicle. The outer handle 16 is turnable between a non-operation position (a position indicated by solid lines in FIGS. 4 and 5) and an operation position (a position indicated by dot-and-dash lines in FIGS. 4 and 5). In the non-operation position, a first end 17*a* (in the present embodiment, a rear end viewed in the front-rear direction of the vehicle) of the handle body is proximate to the outer panel 15. Meanwhile, in the operation position, the first end 17*a* of the handle body is away from the outer panel 15.

To the outer panel 15, a handle case 19 is attached. The handle case 19 is provided to an outer surface of the outer panel 15, and is elongated along the front-rear direction of the vehicle. The handle case 19 includes a case main part 19*a*, and the case main part 19*a* is elongated in the front-rear direction of the vehicle so as to partially cover the outer panel 15 from an outside. Between an outer circumference of the case main part 19*a* and the outer surface of the outer panel 15, a sealing member 20 is interposed such that the sealing member 20 is continuous in an endless manner. The sealing member 20 and the outer panel 15 are interposed between the case main part 19*a* and a base member 21, which is disposed inside the outer panel 15. As such, the case main part 19*a* and the base member 21 are linked to each other, so that the handle case 19 is attached to the outer panel 15. The base member 21 has a part to which a protector 22 is fixed, the part being positioned to be close to the first end 17*a* of the handle body 17. The protector 22 reinforces the base member 21 from the inside of the outer panel 15.

The handle case 19 includes a supporting part 19*b* integrated therewith. In a position being close to a second end 17*b* (in the present embodiment, a front end viewed in the front-rear direction of the vehicle) of the handle body 17, the supporting part 19*b* is thrusted into the inside of the outer panel 15 from the case main part 19*a* (see FIGS. 1 and 2). Furthermore, the second end 17*b* of the handle body 17 is connected consecutively with a supporting arm 23 (see FIGS. 1 and 2), which is thrusted into the outer panel 15. Moreover, the supporting arm 23 is turnably supported by the supporting part 19*b*. Thus, the outer handle 16 is turnable between the non-operation position and the operation position.

The first end 17*a* of the handle body 17 is connected consecutively with a connection arm 24, which is thrusted into the outer panel 15. The base member 21 turnably supports a handle lever 25, which is linked to and is operable together with the connection arm 24. The handle lever 25 is linked to and is operable together with a latch mechanism (not illustrated), which is provided to the vehicle door DA, such that the handle lever 25 can transmit an operating force for opening the door to the latch mechanism.

The first end 17*a* of the handle body includes a switch 26 for determining whether a vehicle user wants to lock the vehicle door DA. The first end 17*a* of the handle body has a window 28 in its outer surface. Through the window 28, a switch button 27 for pressing the switch 26 is allowed to face the outside.

In a position which is rearward of the connection arm 24 in the front-rear direction of the vehicle and which is adjacent to and above the first end 17*a* of the handle body 17, the base member 21 is fixed to a cylinder body 31 of the cylinder lock 30. Each of operations for locking and unlocking the cylinder lock 30 is performed with a mechanical key (see FIGS. 6 and 7).

The handle case 19 has an insertion hole 34. An outer surface of a circumference of the insertion hole 34 is in contact with and engaged with a flange 31*a* located in a first end (outer end) of the cylinder body 31. The cylinder body 31 is inserted into the insertion hole 34, and is fastened to a supporting plate 21*a*, which is provided to the base member 21.

The cylinder lock 30 includes the cylinder body 31 and a rotor 32 (see FIG. 2), which is turnably engaged with the cylinder body 31. The rotor 32 has a key hole 33, into which the mechanical key 29 is to be inserted.

In a position which is close to a second end of the cylinder body 31, the rotor 32 is linked to a turning rod 35, which extends toward the latch mechanism, in a relatively unturnable manner. In response to an operation for locking or unlocking the cylinder lock 30, the rotor 32 is rotated. Consequently, the turning rod 35 inputs a rotating force to the latch mechanism. In response to the input of the rotating force, the latch mechanism operates so as to switch between a lock state and an unlock state of the vehicle door DA.

The cylinder lock 30, which is disposed in the position adjacent to the first end 17*a* of the handle body, is covered with a cover 38 from an outside of the vehicle door DA. The cover 38 is detachably attached to the handle case 19, which is attached to the outer panel 15 and serves as an attached member (a member to be attached).

The cover 38 includes a first cover member 39 and a second cover member 40, each of which is made of a synthetic resin and which are connected with each other. The first cover member 39 is shaped in a substantially flat plate, and is able to be in contact with an outer surface of the handle case main part 19*a*. The second cover member 40 has an outer shape corresponding to an outer shape of the first end 17*a* of the handle body, and is protruded from the first cover member 39. While the outer handle 16 is in the non-operation position, the second cover member 40, which is included in the cover 38 attached to the handle case 19, is smoothly connected to the first end 17*a* of the handle body.

While the outer handle 16 is in the non-operation position, an extension part 39*a* of the first cover member 39 of the cover 38 overlaps the first end 17*a* of the handle body in a side view, as clearly shown in FIG. 1. In this position, the extension part 39*a* is interposed between the first end 17*a* of the handle body and the handle case main part 19*a*. Thus, the first end 17*a* of the handle body is engaged with the extension part 39*a* from the outside of the outer panel 15. Meanwhile, while the outer handle 16 is in the operation position, the first end 17*a* of the handle body is in a position in which the engagement between the first end 17*a* of the handle body and the extension part 39*a* is released. Therefore, while the outer handle 16 is in the non-operation position, the cover 38 cannot be attached to or detached from the handle case 19. Meanwhile, while the outer handle 16 is in the operation position, the cover 38 can be attached to or detached from the handle case 19. Namely, in this position, the cover 38 is detachably attached to the handle case 19.

Figure 3:
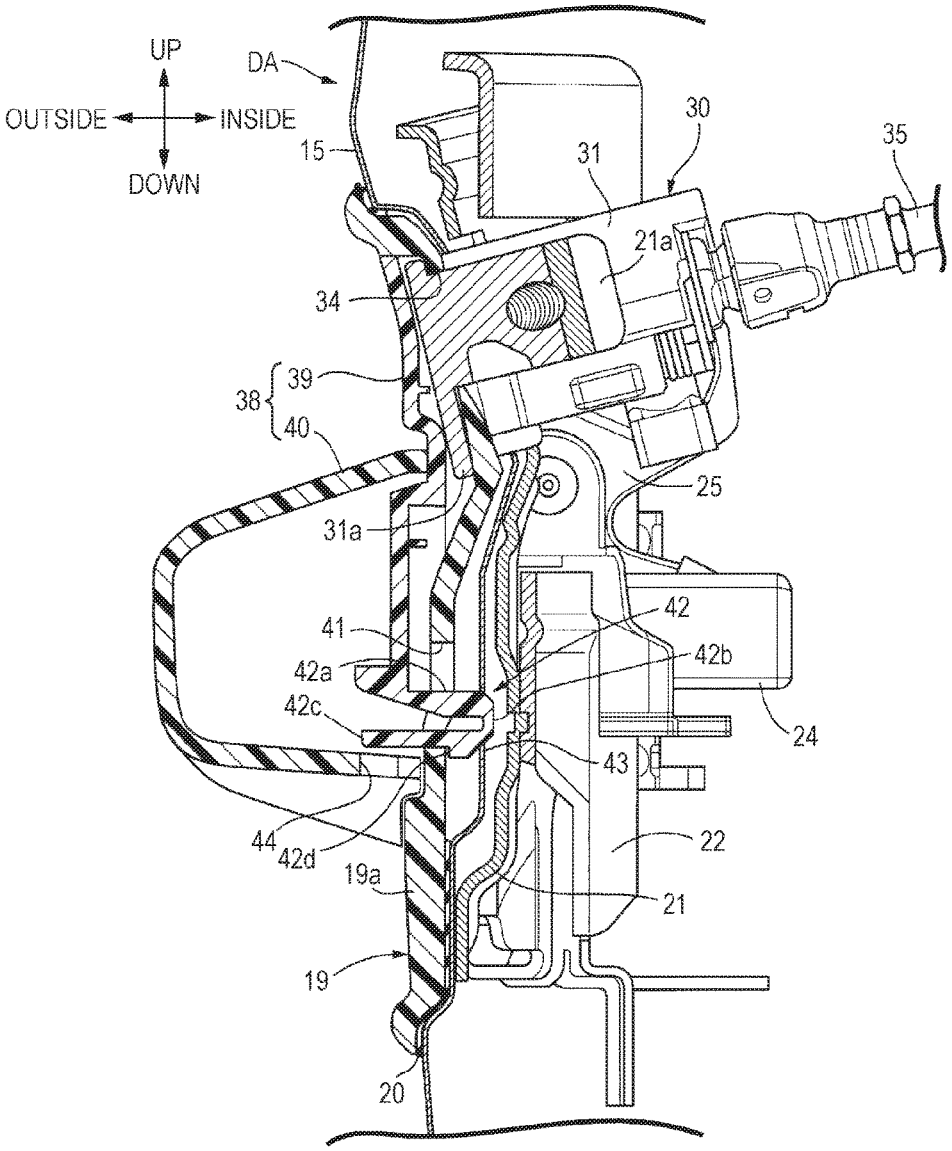
FIG. 3 is a cross-sectional view taken along line 3-3 of FIG. 1.
Figure 4:
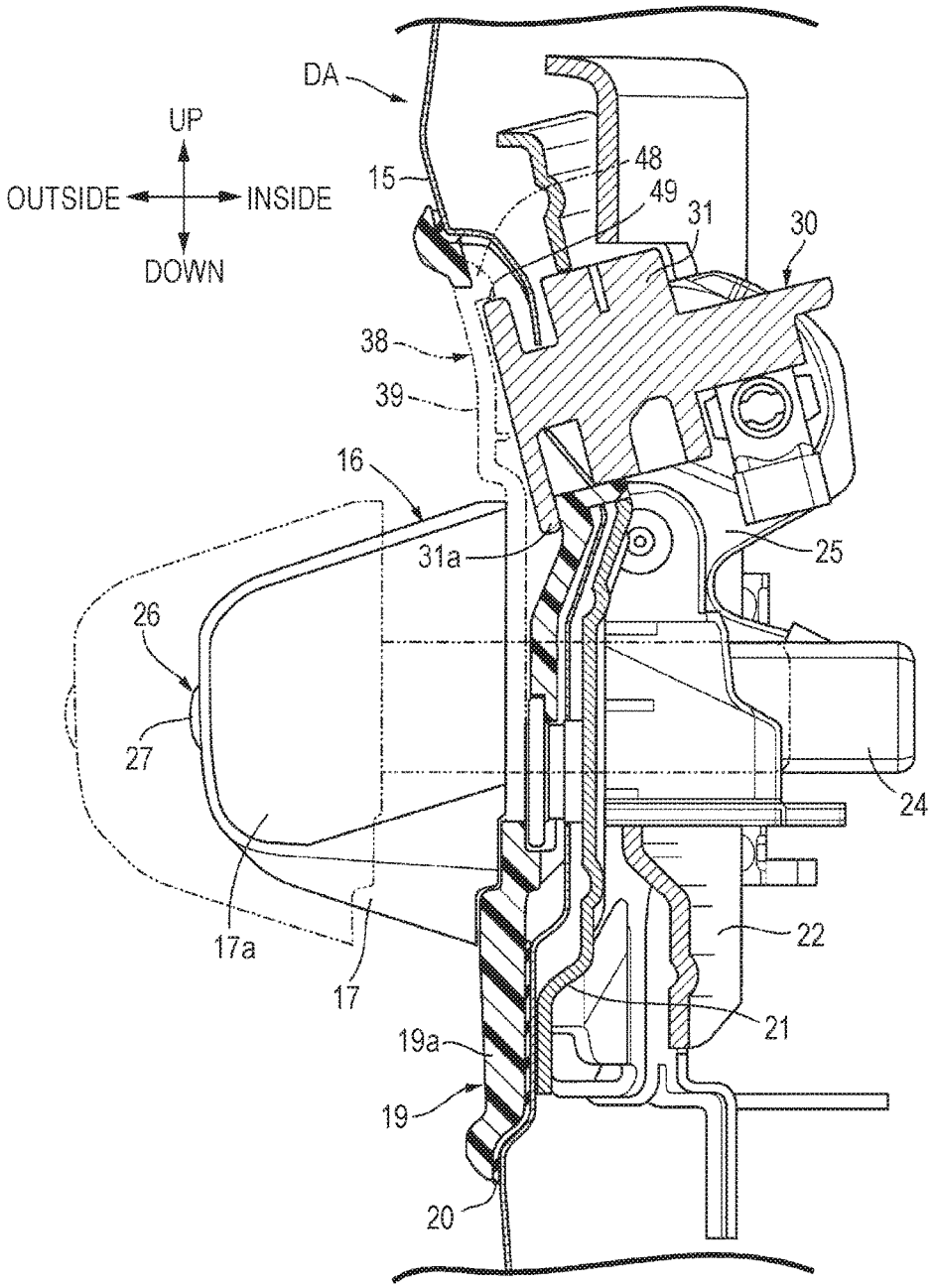
FIG. 4 is a cross-sectional view taken along line 4-4 of FIG. 2.
Figure 5:
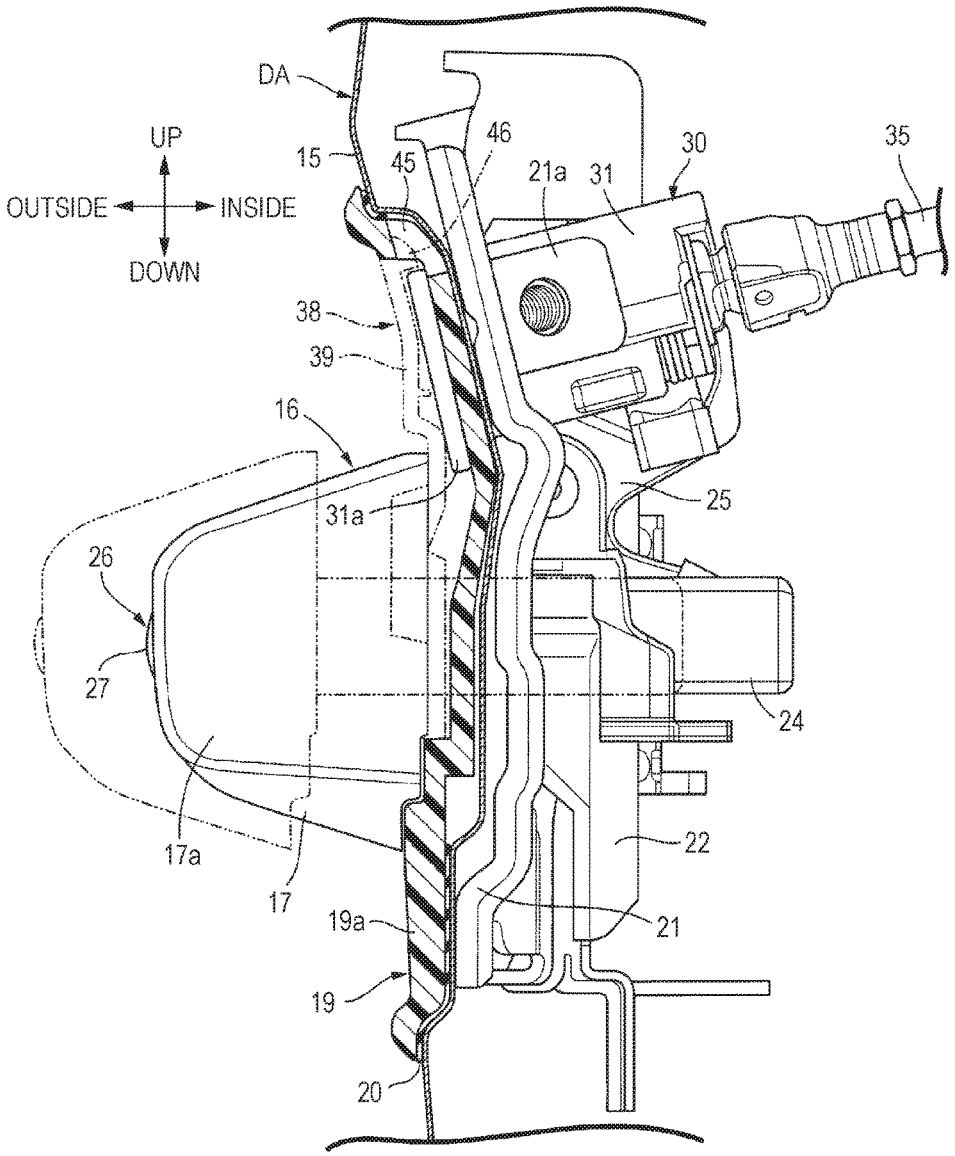
FIG. 5 is a cross-sectional view taken along line 5-5 of FIG. 2.

As clearly shown in FIG. 3, a part of the first cover member 39 of the cover 38 has an engagement part 42 integrated therewith, the part being covered with the second cover member 40. The engagement part 42 is resiliently engaged with a first locking hole 41, which is provided in the handle case main part 19*a*. The engagement part 42 includes a supporting arm portion 42*a*, a linking portion 42*b*, and an engagement arm portion 42*c*, which are integrated together. The supporting arm portion 42*a* has an end consecutively connected to a lower end of the first cover member 39. From the connection, the supporting arm portion 42*a* extends toward an inside viewed in a vehicle width direction. The supporting arm portion 42*a* has an inner end consecutively connected to an end of the linking portion 42*b*. From the connection, the linking portion 42*b* extends downward. From a lower end of the linking portion 42*b*, the engagement arm portion 42*c* extends toward the outside viewed in the vehicle width direction. As such, when viewed in the front-rear direction of the vehicle (the direction of FIG. 3), the engagement part 42 has a substantial U-shape that is opened toward the second cover member 40. Meanwhile, the first locking hole 41 has a rectangular shape elongated in a vertical direction such that a part of the engagement part 42 can be inserted therethrough. The engagement arm portion 42*c* of the engagement part 42 has a step portion 42*d*. The step portion 42*d* is resiliently engaged with an inner surface of a lower edge of the first locking hole 41. The outer panel 15 has a relief hole 43. Through the relief hole 43, a part of the engagement part 42, which is resiliently engaged with the first locking hole 41, is inserted.

The second cover member 40 of the cover 38 has a lower side wall having an operation hole 44. Through the operation hole 44, the resilient engagement between the engagement part 42 and the handle case 19 can be released from an outside of the cover 38.

A second engagement hole 45 is provided in an upper rear part of the handle case 19, the upper rear part being rearward of the cylinder lock 30 in the front-rear direction of the vehicle. A first engagement claw 46, which is engaged with the second engagement hole 45, is projected from an upper rear edge of the first cover member 39 of the cover 38. Furthermore, a second engagement claw 48 is projected from an upper front edge of the first cover member 39 of the cover 38, the upper front edge being located forward of the cylinder lock 30 in the front-rear direction of the vehicle. The second engagement claw 48 is engaged with an upper edge of the insertion hole 34, which is in the handle case 19. Furthermore, the cylinder body 31 of the cylinder lock 30 has a cutout. The cutout and an upper front part of the insertion hole 34 define a third engagement hole 49 in combination. Through the third engagement hole 49, the second engagement claw 48 is inserted.

Figure 6:
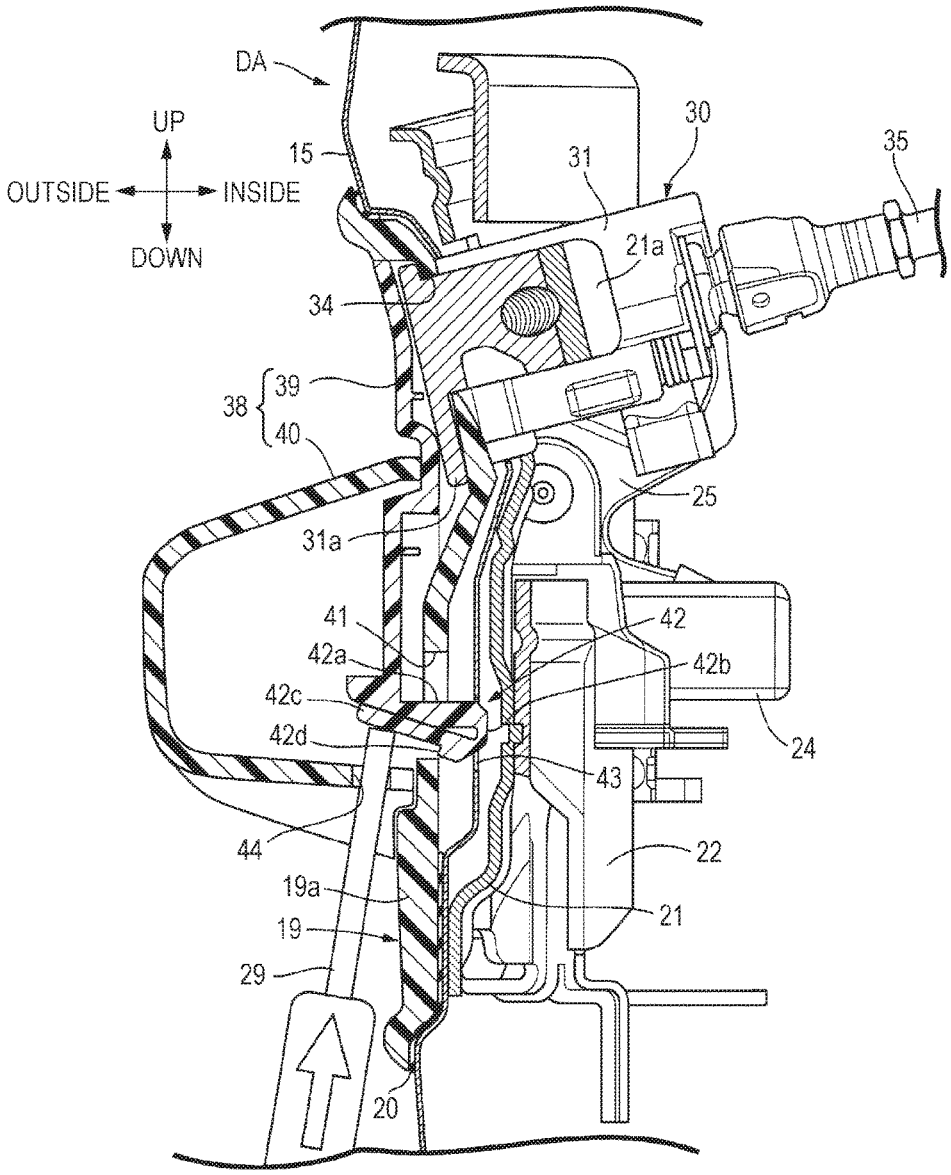
FIG. 6 is a cross-sectional view of FIG. 3 observed when a mechanical key is inserted into the cover.
Figure 7:
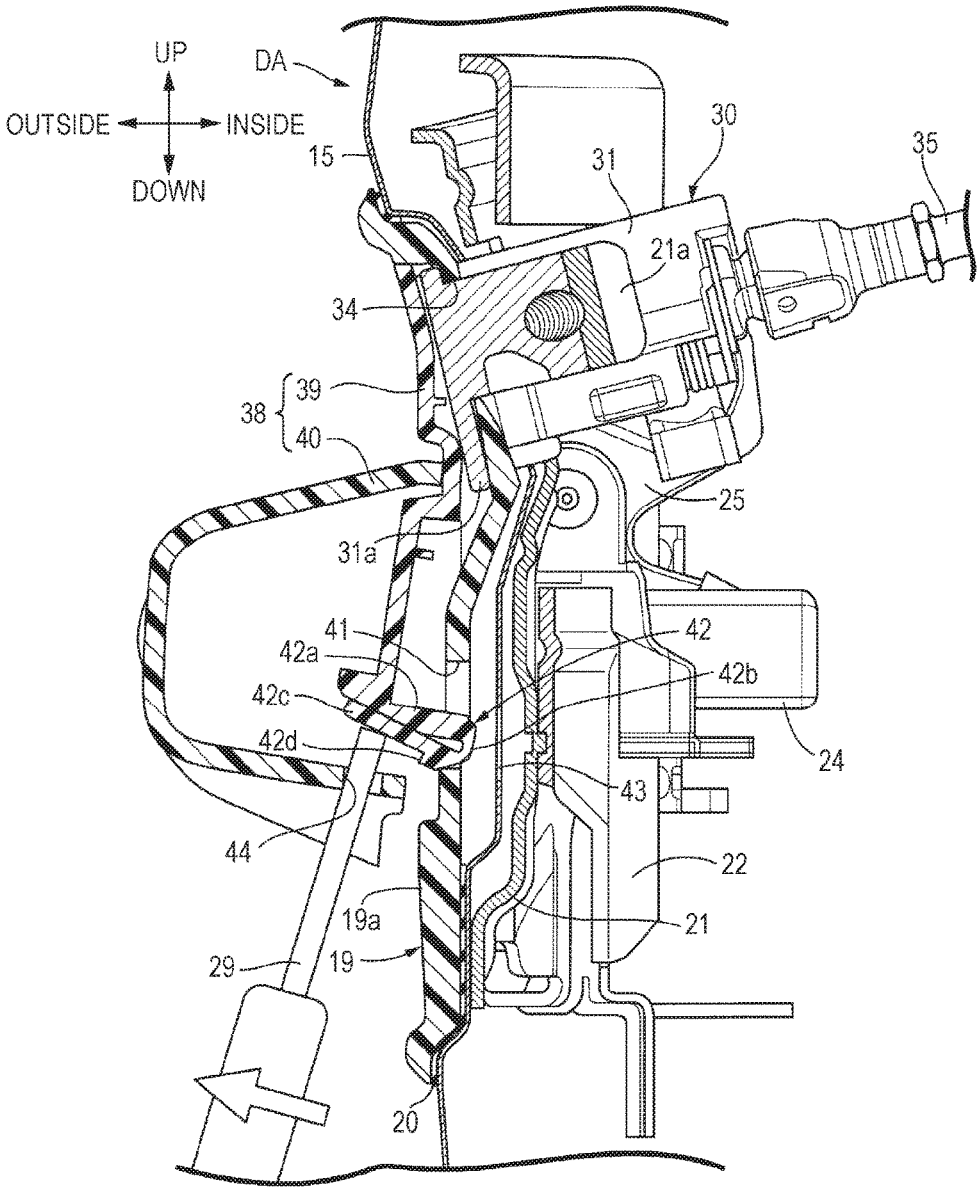
FIG. 7 is a cross-sectional view of FIG. 3 observed during detachment of the cover.

Detachment of the cover 38 from the handle case 19 is performed as follows. That is, while the outer handle 16 is in the operation position, the mechanical key 29, which is used for locking and unlocking the cylinder lock 30, is inserted into the operation hole 44 of the second cover member 40, as shown in FIG. 6. Then, the engagement arm portion 42*c* of the engagement part 42 of the first cover member 39 is pushed upward. Accordingly, the engagement between the engagement part 42 and the first locking hole 41 is released. Subsequently, as shown in FIG. 7, the mechanical key 29 is operated such that the mechanical key 29 gets further away from the outer panel 15 toward the outside. Accordingly, a lower part of the second cover member 40 is displaced toward the outside. Then, the engagement part 42 is separated from the first locking hole 41. Furthermore, the cover 38 is pulled obliquely downward toward the outside of the outer panel 15 such that the first engagement claw 46 is separated from the second engagement hole 45 and the second engagement claw 48 is separated from the third engagement hole 49. Thus, the cover 38 is detached from the handle case 19. Consequently, the cylinder lock 30 is allowed to face the outside.

Meanwhile, attachment of the cover 38 to the handle case 19 is performed as follows. That is, while the outer handle 16 is in the operation position, the first engagement claw 46 is engaged with the second engagement hole 45, and the second engagement claw 48 that is inserted into the third engagement hole 49 is engaged with the upper edge of the insertion hole 34, in a reverse order of the detachment described above. Thereafter, a lower part of the cover 38 is pressed onto the handle case 19. This causes the engagement part 42 to be resiliently engaged with the first locking hole 41. Thus, the cover 38 is attached to the handle case 19.

Next, the following describes effects of the first embodiment. While the outer handle 16 is in the non-operation position, the first end 17*a* of the handle body is engaged with the extension part 39*a*. Meanwhile, while the outer handle 16 is in the operation position, the engagement between the first end 17*a* of the handle body and the extension part 39*a* is released. In this position, the extension part 39*a* is located in the first cover member 39 such that the extension part 39*a* overlaps the first end 17*a* of the handle body in a side view. Only while the outer handle 16 is in the operation position, the cover 38 can be detachably attached to the handle case 19. Thus, even if an impact occurring, e.g., when the vehicle user or the like comes in contact with the cover 38 unintentionally is applied to the cover 38, the engagement between the first end 17*a* of the handle body and the extension part 39*a* is maintained as long as the outer handle 16 is in the non-operation position. This avoids the undesirable detachment of the cover 38.

Figure 8:
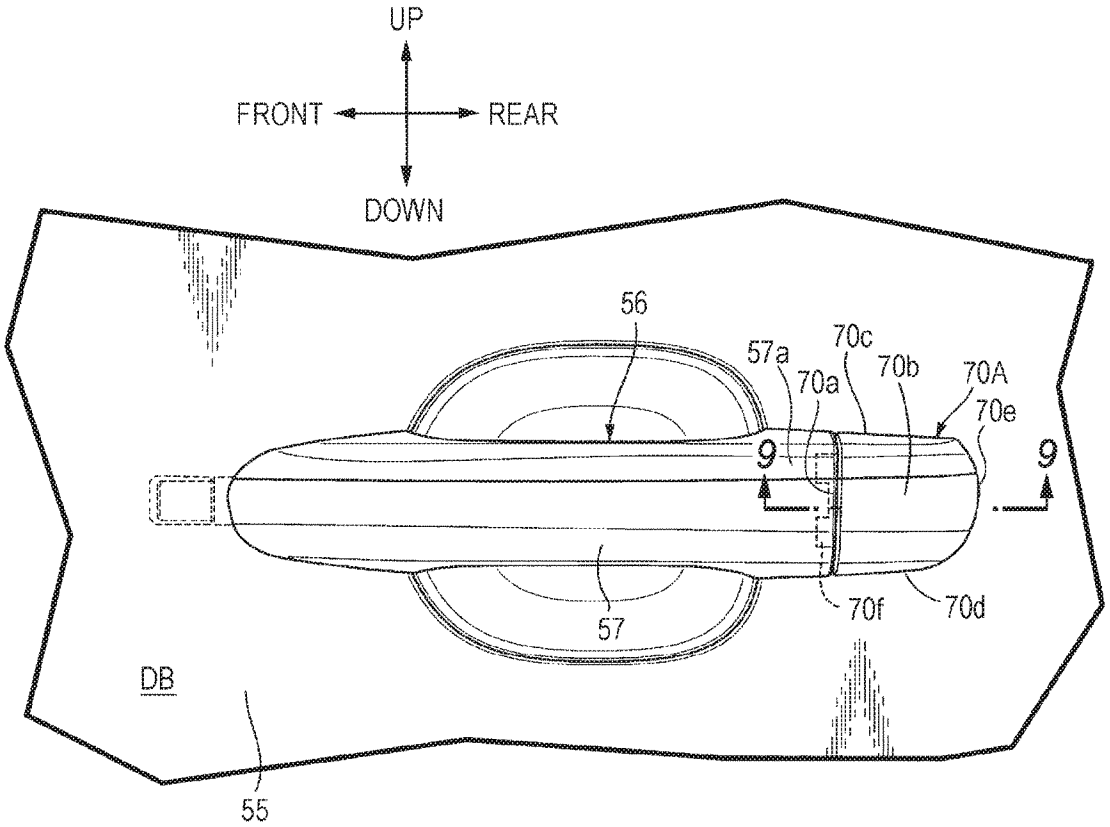
FIG. 8 is a side view of a part of a vehicle door according to a second embodiment.

With reference to FIGS. 8 to 12, a second embodiment of the present disclosure will be described. First, as shown in FIG. 8, a vehicle door DB includes an outer handle 56. The outer handle 56 includes a handle body 57, and the handle body 57 is disposed outside an outer panel 55, and extends in a front-rear direction (i.e., a horizontal direction in FIG. 8) of a vehicle. The handle body 57 is turnable between a non-operation position and an operation position. In the non-operation position, a first end 57*a* (in the present embodiment, a rear end viewed in the front-rear direction of the vehicle) of the handle body is proximate to the outer panel 55. Meanwhile, in the operation position, the first end 57*a* of the handle body is away from the outer panel 55.

Figure 9:
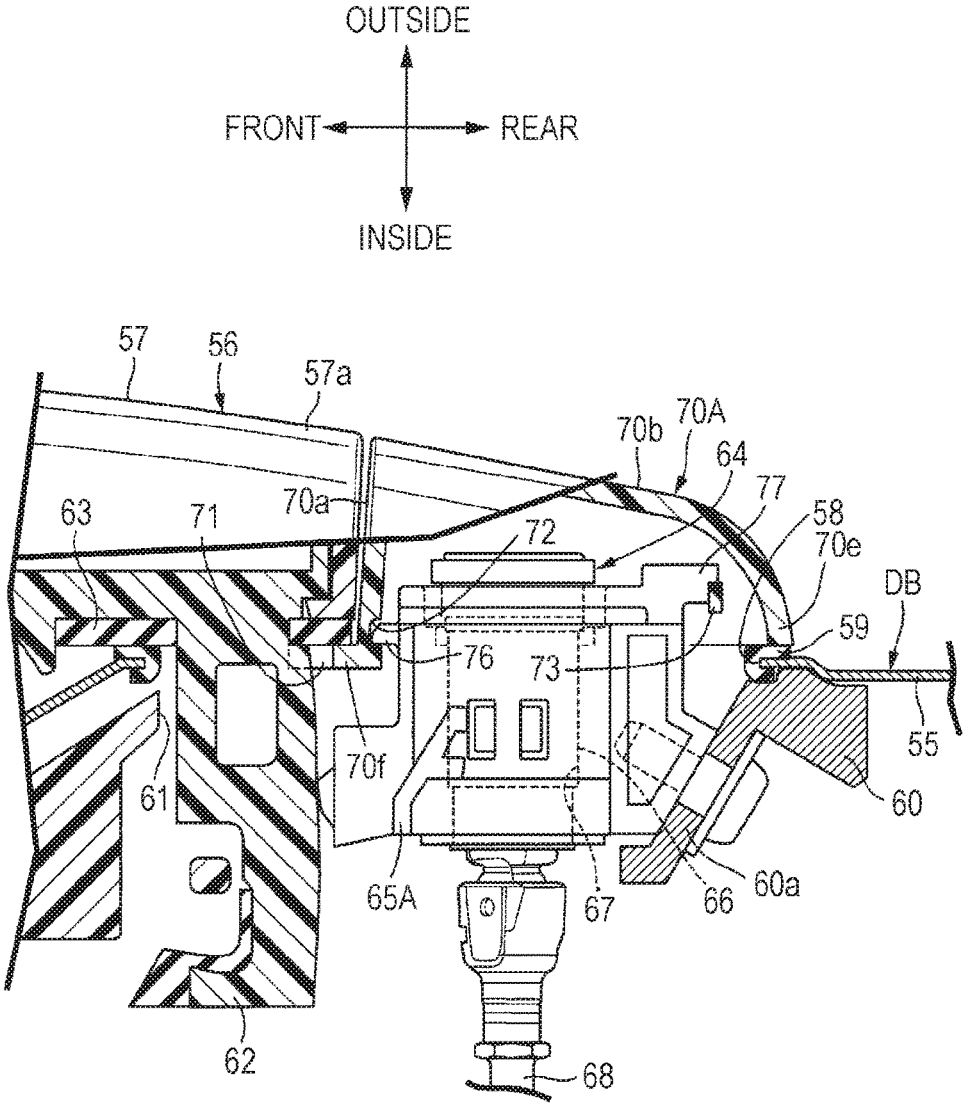
FIG. 9 is a cross-sectional view taken along line 9-9 of FIG. 8.

Now, refer also to FIG. 9. The outer panel 55 has an opening 58 disposed in a part of the outer panel 55, the part being close to the first end 57*a* of the handle body. To a circumference of the opening 58, a sealing member 59 is attached such that the sealing member 59 is continuous in an endless manner.

Furthermore, the outer panel 55 has an inner surface to which a base member 60 is fixed. The base member 60 also has an opening 61 disposed in a part of the base member 60, the part corresponding to the opening 58. The first end 57*a* of the handle body is connected consecutively with a connection arm 62. The connection arm 62 is inserted into a part of the opening 61, the part being closer to the front when viewed in the front-rear direction of the vehicle. In a part surrounding a base of the connection arm 62, an elastic member 63 is attached to the first end 57*a* of the handle body.

To the base member 60, a cylinder body 65A of a cylinder lock 64 is fixed such that the cylinder body 65A is disposed in a position rearward of the connection arm 62 and adjacent to and rearward of the first end 57*a* of the handle body in the front-rear direction of the vehicle. Specifically, the cylinder body 65A is fastened to a supporting plate 60*a* of the base member 60.

The cylinder lock 64 includes the cylinder body 65A and a rotor 66. The rotor 66 is turnably engaged with a cylinder hole 67 of the cylinder body 65A. The rotor 66 is linked to a turning rod 68, which extends toward a latch mechanism (not illustrated), in a relatively unturnable manner.

The cylinder lock 64, which is located in the position adjacent to the first end 57*a* of the handle body (in the present embodiment, the position being adjacent to and being rearward of the first end 57*a* of the handle body in the front-rear direction of the vehicle), is covered with a cover 70A, which is made of a synthetic resin, from an outside of the vehicle door DB. The cover 70A covers the opening 58 of the outer panel 55 in a position rearward of the first end 57*a* of the handle body in the front-rear direction of the vehicle. The cover 70A is an attached member that is to be attached to the outer panel 55. The cover 70A is detachably attached to the cylinder body 65A.

Figure 10:
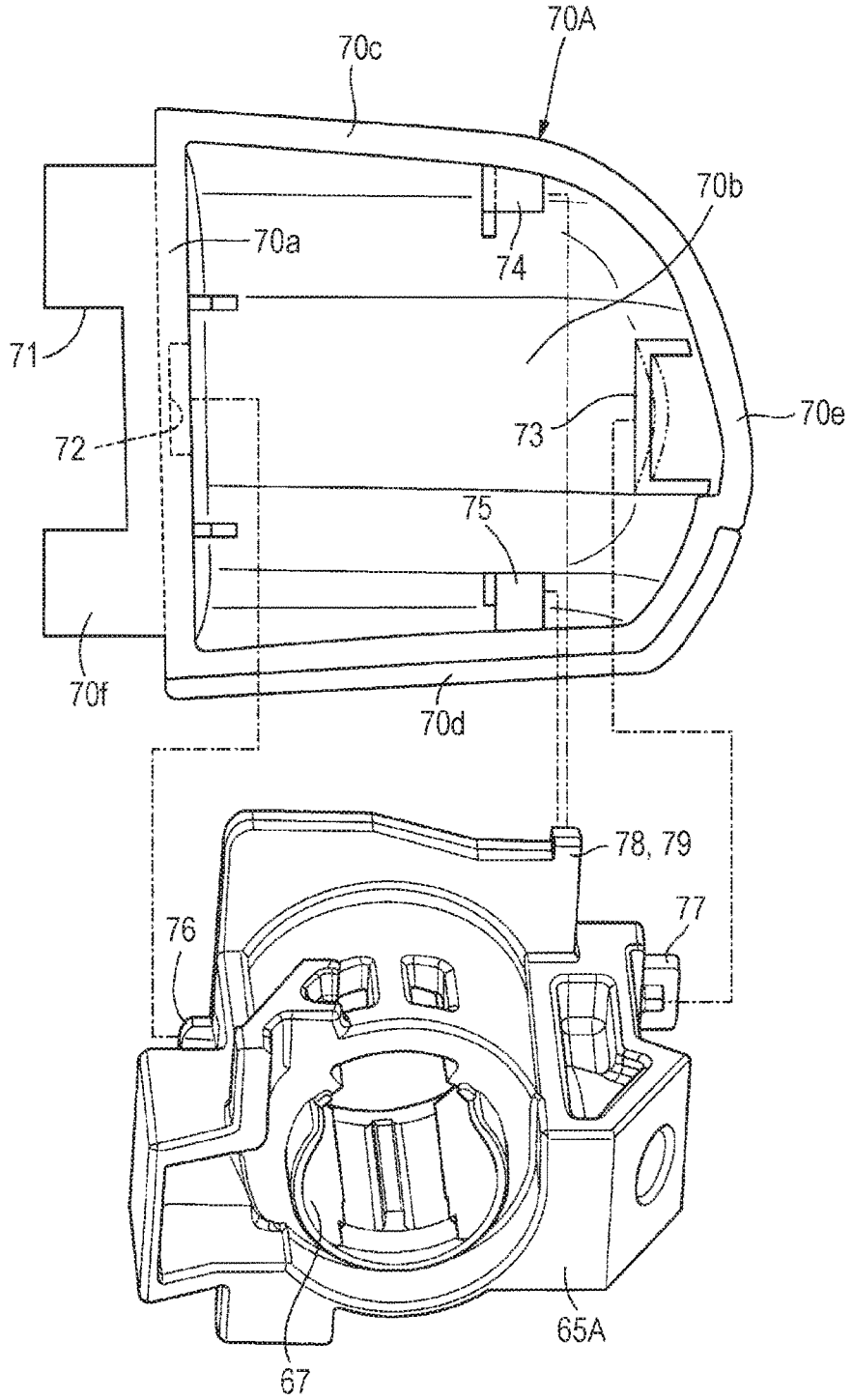
FIG. 10 is an exploded perspective view of a cylinder body and a cover.

Now, refer also to FIG. 10. The cover 70A includes a front wall part 70*a*, a ceiling wall part 70*b*, side wall parts 70*c* and 70*d*, and a rear wall part 70*e*. The front wall part 70*a* faces the first end 57*a* of the handle body from a rear side viewed in the front-rear direction of the vehicle. The ceiling wall part 70*b* is continuous with an upper edge of the front wall part 70*a* such that the ceiling wall part 70*b* faces the cylinder body 65A from an outside of the outer panel 55. The side wall parts 70*c* and 70*d* are continuous with upper and lower edges of the front wall part 70*a* and the ceiling wall part 70*b*. The rear wall part 70*e* is continuous with rear edges of the ceiling wall part 70*b* and the side wall parts 70*c* and 70*d* when viewed in the front-rear direction of the vehicle. The whole shape of the cover 70A is formed such that the cover 70A is smoothly continuous with the first end 57*a* of the handle body while the outer handle 56 is in the non-operation position.

The front wall part 70*a* of the cover 70A includes an extension part 70*f* integrated with the front wall part 70*a*. While the outer handle 56 is in the non-operation position, the first end 57*a* of the handle body is engaged with the extension part 70*f* via the elastic member 63 from the outside of the outer panel 55. The extension part 70*f* overlaps the first end 57*a* of the handle body in a side view. While the outer handle 56 is in the operation position, the first end 57*a* of the handle body is displaced into a position in which the engagement between the first end 57*a* of the handle body and the extension part 70*f* is released. Therefore, while the outer handle 56 is in the non-operation position, the cover 70A cannot be attached to or detached from the cylinder body 65A. Meanwhile, while the outer handle 56 is in the operation position, the cover 70A can be attached to and detached from the cylinder body 65A. Namely, in this position, the cover 70A is detachably attached to the cylinder body 65A.

Note that the extension part 70*f* is protruded forward from the front wall part 70*a* when viewed in the front-rear direction of the vehicle. In order to avoid interference between the extension part 70*f* and the connection arm 62, which is positioned forward of the cover 70A, the extension part 70*f* has a recess 71, in which the connection arm 62 is to be positioned.

In order that the cover 70A is detachably attached to the cylinder body 65A, there provided a locking recess 72 in an inner surface of the front wall part 70*a* of the cover 70A, and there provided a locking projection 73 in the rear wall part 70*e* of the cover 70A such that the locking projection 73 is projected forward when viewed in the front-rear direction of the vehicle. The locking projection 73 has a substantial U-shape that is opened toward the rear wall part 70*e*. The side wall parts 70*c* and 70*d* of the cover 70A respectively have first and second engagement parts 74 and 75, each of which is projected to the inside. The first and second engagement parts 74 and 75 are disposed away from the ceiling wall part 70*b*.

Figure 11C:
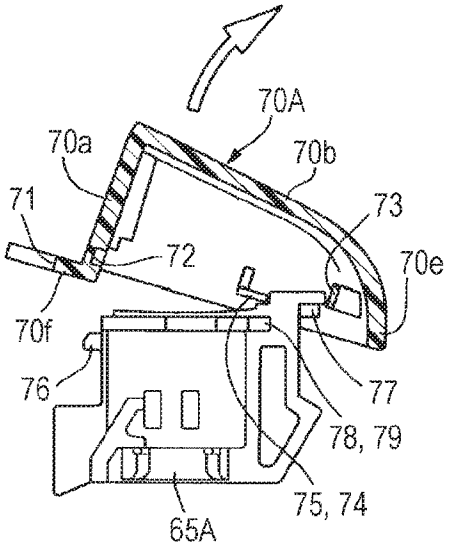
FIGS. 11A, 11B, and 11C are cross-sectional views of FIG. 9, and sequentially illustrate respective steps of detachment of the cover.
Figure 11B:
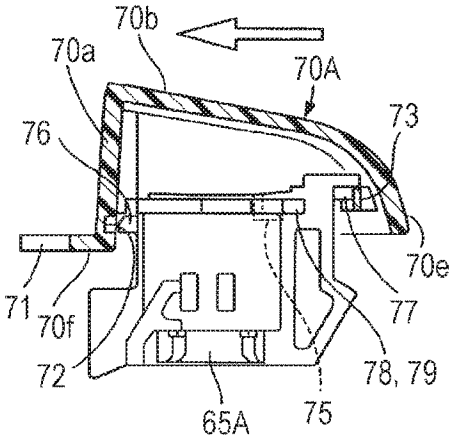
Figure 11A:
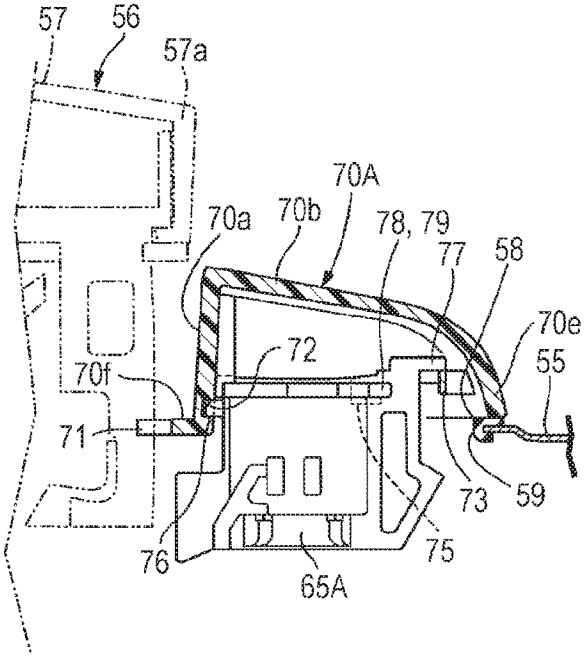
Figure 12:
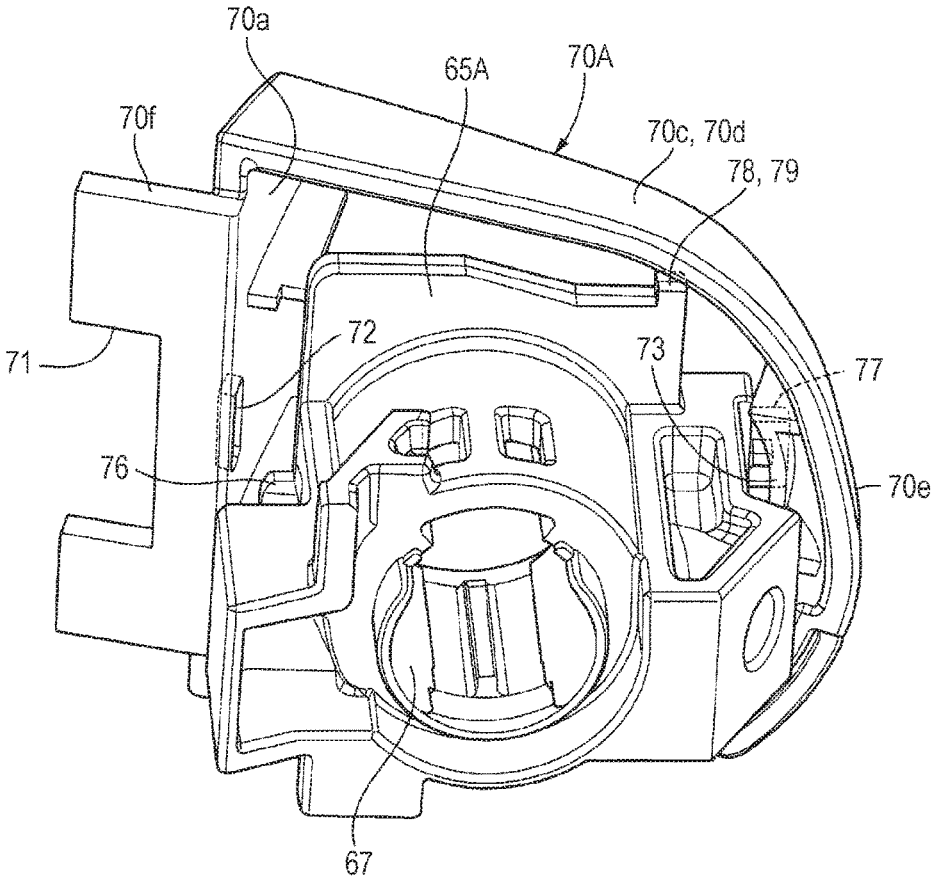
FIG. 12 is a perspective view of a cylinder body and a cover, observed during detachment of the cover from the cylinder body.

Now, refer also to FIG. 11. The cylinder body 65A includes a first engagement protrusion 76, which is configured to be engaged with the locking recess 72, a second engagement protrusion 77, and third and fourth engagement protrusions 78 and 79 such that these engagement protrusions are projected from the cylinder body 65A. The second engagement protrusion 77 is in contact with and is engaged with the locking projection 73 from a front side in the front-rear direction of the vehicle and from the ceiling wall part 70*b* side. The third and fourth engagement protrusions 78 and 79 are in contact with and are engaged with the first and second engagement parts 74 and 75, respectively, from the ceiling wall part 70*b* side.

Detachment of the cover 70A from the cylinder body 65A is performed as follows. That is, while the outer handle 56 is in the operation position as shown in FIG. 11(*a*), the cover 70A is slid rearward in the front-rear direction of the vehicle such that the cover 70A presses and deflects the locking projection 73 being in contact with and being engaged with the second engagement protrusion 77, as shown in FIG. 11(*b*). Consequently, the first engagement protrusion 76 is separated from the locking recess 72. Along with this, the respective contacts and engagements between the first and second engagement parts 74 and 75 and the third and fourth engagement protrusions 78 and 79 are released. Then, as shown in FIGS. 11(*c*) and 12, a front part of the cover 70A is moved to be further away from the cylinder body 65A along the front-rear direction of the vehicle. Thus, the cover 70A can be detached from the cylinder body 65A.

In order to attach the cover 70A to the cylinder body 65A, the above-described detachment process is performed step by step in a reversed order while the outer handle 56 is in the operation position.

The second embodiment brings about effects similar to those of the foregoing first embodiment.

Figure 13:
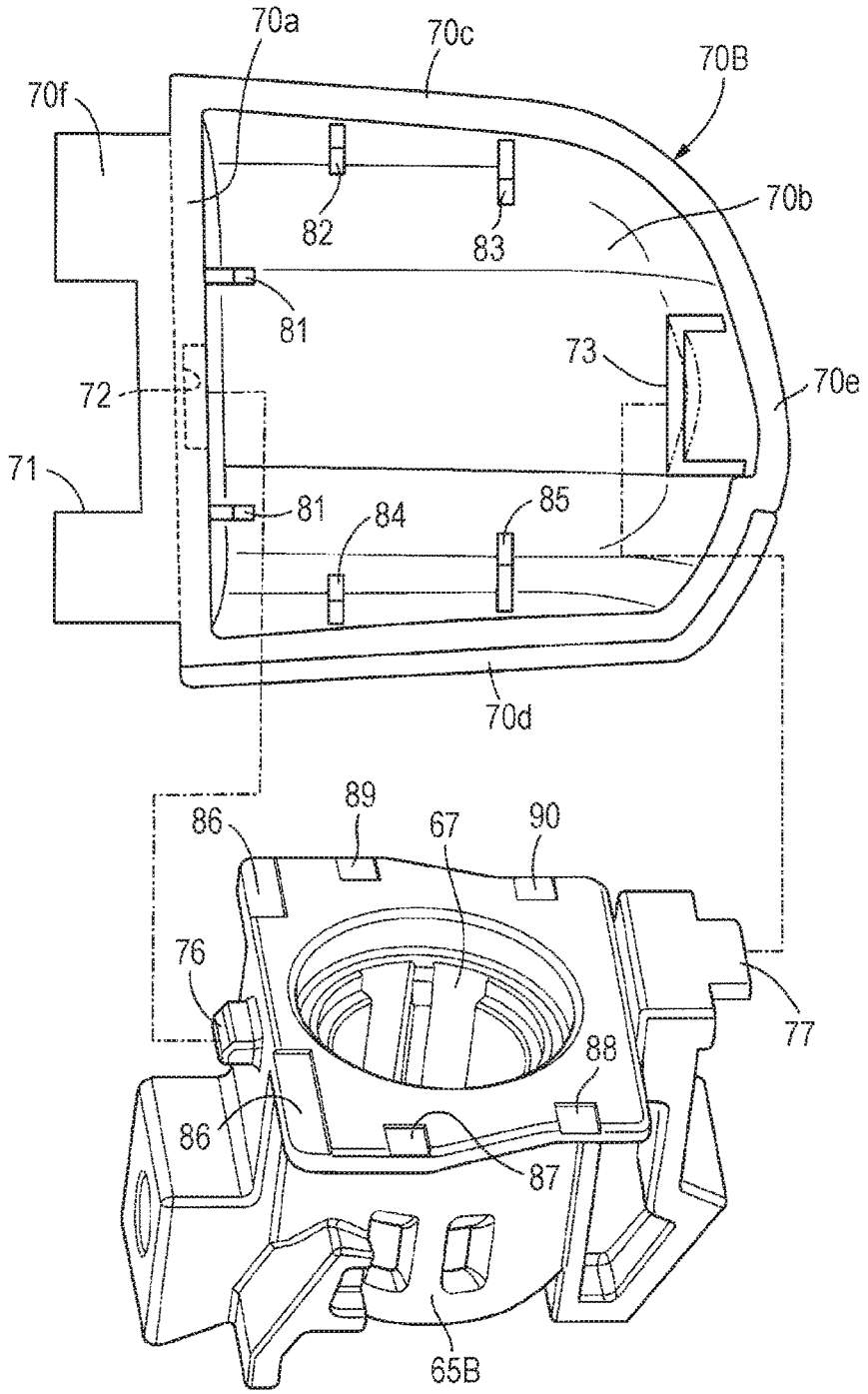
FIG. 13 is an exploded perspective view of a cylinder body and a cover according to a third embodiment.

With reference to FIG. 13, a third embodiment of the present disclosure will be described. A cover 70B, which is an alternative to the cover 70A of the second embodiment, is detachably attached to a cylinder body 65B, which is an alternative to the cylinder body 65A of the second embodiment. As well as the cover 70A of the second embodiment, the cover 70B includes a front wall part 70*a*, a ceiling wall part 70*b*, side wall parts 70*c* and 70*d*, a rear wall part 70*e*, and an extension part 70*f*, which extends forward from the front wall part 70*a* when viewed in a front-rear direction of a vehicle. The front wall part 70*a* has an inner surface provided with a locking recess 72. The rear wall part 70*e* has a locking projection 73 projected therefrom.

The front wall part 70*a* has a pair of first regulating projections 81, and the first regulating projections 81 are disposed at a distance therebetween in a vertical direction. The first regulating projections 81 are projected rearward in the front-rear direction of the vehicle. The side wall part 70*c* has second and third regulating projections 82 and 83, which are projected therefrom and are disposed at a distance therebetween in the front-rear direction of the vehicle. The side wall part 70*d* has fourth and fifth regulating projections 84 and 85, which are projected therefrom and are disposed at a distance therebetween in the front-rear direction of the vehicle.

The first regulating projections 81 define an end of a rearward movement of the cover 70B in the front-rear direction of the vehicle, with respect to the cylinder body 65B. Furthermore, the first regulating projections 81 also define an end of a movement of the cover 70B toward an inside in a vehicle width direction. The cylinder body 65B has a front edge having flat contact surfaces 86. The contact surfaces 86 come in contact with the first regulating projections 81 from the inside in the vehicle width direction. Second to fifth regulating projections 82 to 85 define an end of a vertical movement of the cover 70B with respect to the cylinder body 65B. Also, the second to fifth regulating projections 82 to 85 define an end of a movement of the cover 70B toward the inside in the vehicle width direction. The cylinder body 65B has flat contact surfaces 87, 88, 89, and 90, which are in contact with the second to fifth regulating projections 82 to 85, respectively.

In the third embodiment, detachment of the cover 70B from the cylinder body 65B is performed as follows. That is, while an outer handle 56 (see the second embodiment) is in an operation position, the cover 70B is slid rearward in the front-rear direction of the vehicle such that the cover 70B presses and deflects (as indicated by dot-and-dash lines in FIG. 13) the locking projection 73 being in contact with and being engaged with the second engagement protrusion 77. This causes the first engagement protrusion 76 to be separated from the locking recess 72. Meanwhile, attachment of the cover 70B to the cylinder body 65B is performed as follows. That is, while the outer handle 56 is in the operation position, the cover 70B is slid rearward in the front-rear direction of the vehicle such that the cover 70B presses and deflects the locking projection 73 being in contact with and being engaged with the second engagement protrusion 77. Then, the first engagement protrusion 76 can be engaged with the locking recess 72.

The foregoing has explained the embodiments of the present disclosure. However, embodiments of the present disclosure are not limited to the above embodiments. The above embodiments may be altered or varied in various ways within a technical scope of the above embodiments.

In the above embodiments, the covers 38, 70A, and 70B configured to be detachably attached to the handle case 19, the cylinder body 65A, and the cylinder body 65B, each of which is an attached member, have been described, for example. Alternatively, each of the covers may be detachably attached to the outer panel of the vehicle door.

An outer handle device for a vehicle door according to an embodiment of the present disclosure may be any of the below-described first to third outer handle devices for a vehicle door.

The first outer handle device for a vehicle door is configured such that: an outer handle (16, 56) including a handle body (17, 57) being disposed outside an outer panel (15, 55) of a vehicle door (DA, DB) and extending in a front-rear direction of a vehicle is provided to the vehicle door (DA, DB) such that the outer handle (16, 56) is turnable between a non-operation position in which a first end (17*a*, 57*a*) of the handle body (17, 57) is proximate to the outer panel (15, 55) and an operation position in which the first end (17*a*, 57*a*) of the handle body (17, 57) is away from the outer panel (15, 55); a cover (38, 70A, 70B) for covering, from an outside of the vehicle door (DA, DB), a cylinder lock (30, 64) disposed in a position adjacent to the first end (17*a*, 57*a*) of the handle body (17, 57) is configured to be detachably attached to the outer panel (15, 55) or an attached member (19, 65A, 65B) that is to be attached to the outer panel (15, 55); an extension part (39*a*, 70*f*) that is engaged with the first end (17*a*, 57*a*) of the handle body (17, 57) while the outer handle (16, 56) is in the non-operation position but is released from the engagement while the outer handle (16, 56) is in the operation position is formed in the cover (38, 70A, 70B) such that the extension part (39*a*, 70*f*) overlaps the first end (17*a*, 57*a*) of the handle body (17, 57) in a side view; and the cover (38, 70A, 70B) is configured to be detachably attached to the attached member (19, 65A, 65B) or the outer panel (15, 55) such that the attachment and the detachment are possible while the outer handle (16, 56) is in the operation position.

The second outer handle device for a vehicle door is the first outer handle device for the vehicle door configured such that the cover (38) includes: an engagement part (42), which is configured to be resiliently engaged with the attached member (19) or the outer panel (15); and an operation hole (44), through which an operation for releasing the resilient engagement between the engagement part (42) and the attached member (19) or the outer panel (15) is allowed to be performed from an outside of the cover (38).

The third outer handle device for a vehicle door is the first or second outer handle device for the vehicle door configured such that: the cover (70A, 70B) is configured to be detachably attached to the attached member (65A, 65B) or the outer panel (55) such that sliding the cover (70A, 70B) in the front-rear direction of the vehicle while the outer handle (56) is in the operation position allows the cover (70A, 70B) to be detached from the attached member (65A, 65B) or the outer panel (55).

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An outer handle device for a vehicle door, comprising:

an outer handle (16, 56) provided to a vehicle door (DA, DB); and a cover (38, 70A, 70B), wherein the outer handle (16, 56) includes a handle body (17, 57) that is disposed outside an outer panel (15, 55) of the vehicle door (DA, DB) and extends in a front-rear direction of a vehicle, the cover (38, 70A, 70B) is configured to cover, from an outside of the vehicle door (DA, DB), a cylinder lock (30, 64) located in a position adjacent to a first end (17*a*, 57*a*) of the handle body (17, 57), the cover (38, 70A, 70B) is configured to be attached to the outer panel (15, 55) or an attached member (19, 65A, 65B) that is to be attached to the outer panel (15, 55), and the cover (38, 70A, 70B) has an extension part (39*a*, 70*f*) protruding forward in the front-rear direction, the outer handle (16, 56) is turnable between a non-operation position and an operation position, while the outer handle (16, 56) is in the non-operation position, the first end (17*a*, 57*a*) of the handle body is proximate to the outer panel (15, 55), and the extension part (39*a*, 70*f*) is engaged with the first end (17*a*, 57*a*) of the handle body and overlaps the first end (17*a*, 57*a*) of the handle body in a side view, the extension part (39*a*, 70*f*) is interposed between the first end (17*a*, 57*a*) of the handle body and the attached member (19, 65A, 65B) in a vehicle width direction, while the outer handle (16, 56) is in the operation position, the first end (17*a*, 57*a*) of the handle body is away from the outer panel (15, 55), the engagement between the extension part (39*a*, 70*f*) and the first end (17*a*, 57*a*) of the handle body is released, and the cover (38, 70A, 70B) is attachable to the attached member (19, 65A, 65B) or the outer panel (15, 55) and is detachable from the attached member (19, 65A, 65B) or the outer panel (15, 55), the cover (38) includes an operation hole (44), and an engagement part (42) configured to be resiliently engaged with the attached member (19) or the outer panel (15), the elastic engagement between the engagement part (42) and the attached member (19) or the outer panel (15) is releasable through the operation hole (44) from an outside of the cover (38), and the engagement part (42) comprises:

a supporting arm portion (42*a*) extending toward an inside in the vehicle width direction;

a linking portion (42*b*) being connected to an inner end of the supporting arm portion (42*a*) and extending downward; and an engagement arm portion (42*c*) extending from a lower end of the linking portion (42*b*) toward an outside in the vehicle width direction, the engagement arm portion (42*c*) having a step portion (42*d*) configured to be resiliently engaged with the attached member (19).

2. An outer handle device for a vehicle door, comprising:

an outer handle (16, 56) provided to a vehicle door (DA, DB); and a cover (38, 70A, 70B), wherein the outer handle (16, 56) includes a handle body (17, 57) that is disposed outside an outer panel (15, 55) of the vehicle door (DA, DB) and extends in a front-rear direction of a vehicle, the cover (38, 70A, 70B) is configured to cover, from an outside of the vehicle door (DA, DB), a cylinder lock (30, 64) located in a position adjacent to a first end (17*a*, 57*a*) of the handle body (17, 57), the cover (38, 70A, 70B) is configured to be attached to the outer panel (15, 55) or an attached member (19, 65A, 65B) that is to be attached to the outer panel (15, 55), and the cover (38, 70A, 70B) has an extension part (39*a*, 70*f*) protruding forward in the front-rear direction, the outer handle (16, 56) is turnable between a non-operation position and an operation position, while the outer handle (16, 56) is in the non-operation position, the first end (17*a*, 57*a*) of the handle body is proximate to the outer panel (15, 55), and the extension part (39*a*, 70*f*) is engaged with the first end (17*a*, 57*a*) of the handle body and overlaps the first end (17*a*, 57*a*) of the handle body in a side view, the extension part (39*a*, 70*f*) is interposed between the first end (17*a*, 57*a*) of the handle body and the attached member (19, 65A, 65B) in a vehicle width direction, while the outer handle (16, 56) is in the operation position, the first end (17*a*, 57*a*) of the handle body is away from the outer panel (15, 55), the engagement between the extension part (39*a*, 70*f*) and the first end (17*a*, 57*a*) of the handle body is released, and the cover (38, 70A, 70B) is attachable to the attached member (19, 65A, 65B) or the outer panel (15, 55) and is detachable from the attached member (19, 65A, 65B) or the outer panel (15, 55), the cover (70A, 70B) comprises a locking recess (72) in an inner surface of the cover (70A, 70B), and the attached member (65A, 65B) comprises a first engagement protrusion (76) which is configured to be engaged with the locking recess (72).

* * * * *